US005438942A

United States Patent [19]

Okuno et al.

[11] Patent Number: 5,438,942

[45] Date of Patent: Aug. 8, 1995

[54] TURNING ZIGZAG EMBROIDERY MACHINE

[75] Inventors: Akira Okuno; Takashi Isobe, both of Yokohama; Keiichi Ito, Tokyo, all of Japan

[73] Assignee: Nippon Denpa Co., Ltd., Tokyo, Japan

[21] Appl. No.: 133,143

[22] Filed: Oct. 20, 1993

[30] Foreign Application Priority Data

Oct. 16, 1991 [JP] Japan ..... 3-296284
Aug. 20, 1992 [JP] Japan ..... 4-244300

[51] Int. Cl.[6] ..... D05B 21/00; D05C 9/06

[52] U.S. Cl. ..... 112/102.5; 112/103; 112/470.04; 112/470.06

[58] Field of Search ..... 112/121.12, 103, 78, 112/98, 266.1, 262.3; 364/470

[56] References Cited

U.S. PATENT DOCUMENTS 4,598,655 7/1986 Takenoya .
4,841,891 6/1989 Hashimoto et al. ..... 112/103 X
5,255,198 10/1993 Yokoe et al. ..... 112/103 X
5,282,142 1/1994 Asano ..... 112/103 X

FOREIGN PATENT DOCUMENTS 46-1137 1/1971 Japan .
56-106683 8/1981 Japan .
58-56630 12/1983 Japan .
63-203188 8/1988 Japan .
4-11237 2/1992 Japan .
5192466 8/1993 Japan .

*Primary Examiner*—Peter Nerbun
*Attorney, Agent, or Firm*—Oblon, Spivak, McClelland, Maier & Neustadt

[57] ABSTRACT

Disclosed herein is a turning zigzag embroidery machine adapted to read in from outside needle center data N, which permits scaling up or down or alteration of an embroidery pattern, and to convert the needle center data into frame center data C to reproduce an embroidery pattern in an improved form. Of externally read-in needle center data N ($\Delta X$, $\Delta Y$, $\theta$, W) and the data of needle center N on X–Y axes, this turning zigzag embroidery machine transforms, for example, data Nk (Xk, Yk, $\theta$k, Wk) of needle center Nk into data Ck (xk, yk, $\theta$k, Wk) of frame center Ck on x–y axes by arithmetic conversion. Then, in order to advance an embroidering needle 10 to the needle center Nk, a rotatable frame is shifted in the directions of x- and y-axes and at the same time it is turned through a given rotational angle $\theta=\theta k$ in the direction of arrow E. At each of the advanced needle center positions, the embroidering needle is imparted with a rocking motion across a rocking width Wk to make a stitch at a given stitch point Sk, thereby reproducing an embroidery pattern on a cloth.

3 Claims, 10 Drawing Sheets

TURNING ZIGZAG EMBROIDERY MACHINE

BACKGROUND OF THE INVENTION

1. Field of the Art

This invention relates to a turning zigzag embroidery machine, which is suitable, for example, for reproducing an embroidery design or pattern with turning zigzag figures according to given stitch data.

2. Technical Background

Generally, so-called turning zigzag sewing machines, which can serve for the turning zigzag embroidering, have been known in the art, for instance, from Japanese Laid-Open Patent Application 63-203188. The conventional turning zigzag embroidery machine of this sort is usually composed of a base table adapted to hold a lower embroidering thread in position, an embroidery machine head located above the base table and adapted to reciprocate an embroidering needle with an upper thread up and down at a confronting position relative to the lower thread while simultaneously rocking the embroidering needle across a given width, a movable frame located movably on the base table under the embroidery machine head and driven from a drive source for movements in sideward directions and in forward and backward directions (in the directions of x- and y-axes) on the base table, and a rotatable frame adapted to hold embroidering cloth in a stretched state within the movable frame and to be turned together with the embroidering cloth within the movable frame by a rotational drive source provided on the movable frame.

With a conventional turning zigzag sewing machine of this sort, as the embroidering needle on the head of the embroidery machine is put in rocking movement across a certain rocking width or widths simultaneously with reciprocating movement, the movable frame is driven in the directions of x- and y-axes and the embroidering cloth is turned together with the rotatable frame on the movable frame to advance the embroidering needle from one stitch point to another. By repeating such a needle advancing action, an embroidery pattern with a turning zigzag figure or figures is reproduced on the cloth according to the rocking width of the embroidering needle. An embroidery machine of this sort has an advantage that even complicated embroidery patterns can be formed in a relatively short period of time.

The turning zigzag sewing machines of the sort mentioned above usually includes a position sensor for detection of displacements of the movable frame in the directions of x- and y-axes, a rotational angle sensor for detection of rotational angles of the rotatable frame relative to the movable frame, and a rocking width sensor for detection of the rocking width of the embroidering needle, in order to reproduce an embroidery pattern according to a prior teaching operation or the so-called "exemplary learning" prior to an actual operation.

More specifically, in a prior teaching operation, a skilled operator makes adjustments of the rocking width of the reciprocating embroidering needle while at the same time manually moving or turning the movable and rotatable frames to simulate the motions which are necessary to produce a desired embroidery pattern. At this time, the signals from the respective sensors are read in so as to store the necessary positional data of the center of the rotatable frame relative to the center of the embroidering needle, including the position of the movable frame (or the center of the rotatable frame), the rotational angle of the rotatable frame, and the rocking width of the embroidering needle. Thereafter, the above-mentioned drives for the movable and rotatable frames are operated according to the stored data to reproduce the embroidery pattern repeatedly in the same manner as by a skilled operator.

In case of the above-described prior art turning zigzag embroidery machine, however, the embroidery machine head as well as the drives for the movable and rotatable frames are operated according to the so-called teaching data which are input by a skilled operator in a prior teaching operation. Therefore, the conventional embroidery machine is capable of simple reproductions of an embroidery pattern as learned through a teaching operation, but it is incapable of scaling up or down the size of or altering the design of am embroidery pattern or changing its position when it is desired to reproduce the pattern in a more improved quality.

In this connection, the applicants proposed in their prior patent application, Japanese Patent Application 4-232853, a stitch data preparation device (hereinafter referred to as "the prior art") which is provided with arithmetic conversion means to convert the data of the center of the rotatable frame relative to the center of the embroidering needle, as learned from a teaching operation including the rotational angle of the rotatable frame and the rocking width of the embroidering needle, into data of the center of the embroidering needle relative to the center of the rotatable frame, and to scale up or down or to alter an embroidery pattern on the basis of the arithmetically converted data.

According to the stitch data preparation device of the prior art, the data of an embroidery pattern, which has been enlarged or reduced in size or altered in shape on the basis of the data of the embroidering needle center relative to the rotatable frame center, are stored in a memory medium like a floppy disk to supply the edited data to the outside as output data. Therefore, the output data of the prior art device, based on the needle center, would be unable to operate a turning zigzag sewing machine even if they could be loaded on the sewing machine.

Further, if it may be possible to add data of the rotational angle and rocking width, for example, at the time of preparing stitch data by entering stitch points on a pattern input device like a tablet, to obtain needle center data which are easily editable to scale up or down or to alter an embroidery pattern design. However, this data exclusively consists of needle center data, so that they are unable to operate conventional turning zigzag sewing machines, failing to utilize the data entered through a tablet or a similar pattern input device.

In view of the above-discussed problems of the prior art, the present invention has as its object the provision of a turning zigzag embroidery machine which is capable of reading in needle center data, a data format which permits data editing for scaling up or down an embroidery pattern or for other purposes, and arithmetically converting the input data into a format which can control the operations of the embroidery machine head and the movable and rotatable frame drives to reproduce an embroidery pattern which is improved in quality.

DISCLOSURE OF THE INVENTION

According to the present invention, in order to solve the above-mentioned problems, there is provided a turning zigzag embroidery machine including a base table for positioning a lower embroidery thread thereon, an embroidery machine head located over the base table and arranged to reciprocate an embroidering needle with an upper thread up and down in a confronting position relative to the lower thread and at the same time to impart a rocking motion to the embroidering needle over a predetermined width W, a movable frame provided movably on the base table at a position under the embroidery machine head and driven from a movable frame drive source for movements in the directions of x- and y-axes on the base table, and a rotatable frame adapted to hold embroidering cloth in a stretched state within the movable frame and rotated by a rotatable frame drive source on the movable frame to turn the embroidering cloth through a given angle $\theta$ within the movable frame; characterized in that the turning zigzag embroidery machine comprises: a data read-in means for reading in input needle center data including the needle rocking width W and rotational angle $\theta$; arithmetic conversion means for converting the input needle center data into frame center data including the rotational angle $\theta$ and the rocking width W; and an embroidery machine operation control means adapted to control the operations of the embroidery machine head and the movable and rotatable frame drive sources according to the arithmetically converted frame center data from the arithmetic conversion means.

In this instance, the arithmetic conversion means is preferred to be arranged to convert the input needle center data N ($\Delta X$, $\Delta Y$, $\theta$, W) from the data reading-in means into frame center data C ($\Delta x$, $\Delta y$, $\theta$, W) of the center C of the rotatable frame, by means of trigonometric functions based on the rotational angle $\theta$.

The above-mentioned movable frame drive source includes an x-axis motor which drives the movable frame in the direction of x-axis and a y-axis motor which drives the movable frame in the direction of y-axis. The rotational frame drive source is constituted by a movable frame drive motor which is arranged to turn the rotatable frame through the angle $\theta$ on the movable frame. The embroidery machine head is provided with a needle rocking motor which imparts a rocking motion to the embroidering needle across the width W.

Preferably, each of the above-mentioned x-axis motor, y-axis motor, rotatable frame drive motor and needle rocking motor is constituted by a pulse motor which is driveable by open-loop control according to pulse signals which are produced by the embroidery machine control means on the basis of the frame center data, converted from the input needle center data by the arithmetic conversion means.

With the above-described arrangements, the input needle center data (which permit scaling up or down of embroidery pattern sizes) are automatically converted by the arithmetic conversion means into data of the frame center relative to the needle center, that is, into corresponding frame center data including the rotational angle $\theta$ and the rocking width W. On the basis of the arithmetically converted data, the embroidering needle on the machine head is reciprocated up and down and simultaneously rocked across the width W, while the movable frame is displaced in the directions of x- and y-axis and the cloth on the rotatable frame is turned through the angle $\theta$, making it possible to reproduce repeatedly the embroidery pattern which corresponds to the input data.

BEST MODE FOR CARRYING OUT THE INVENTION

Figure 1:
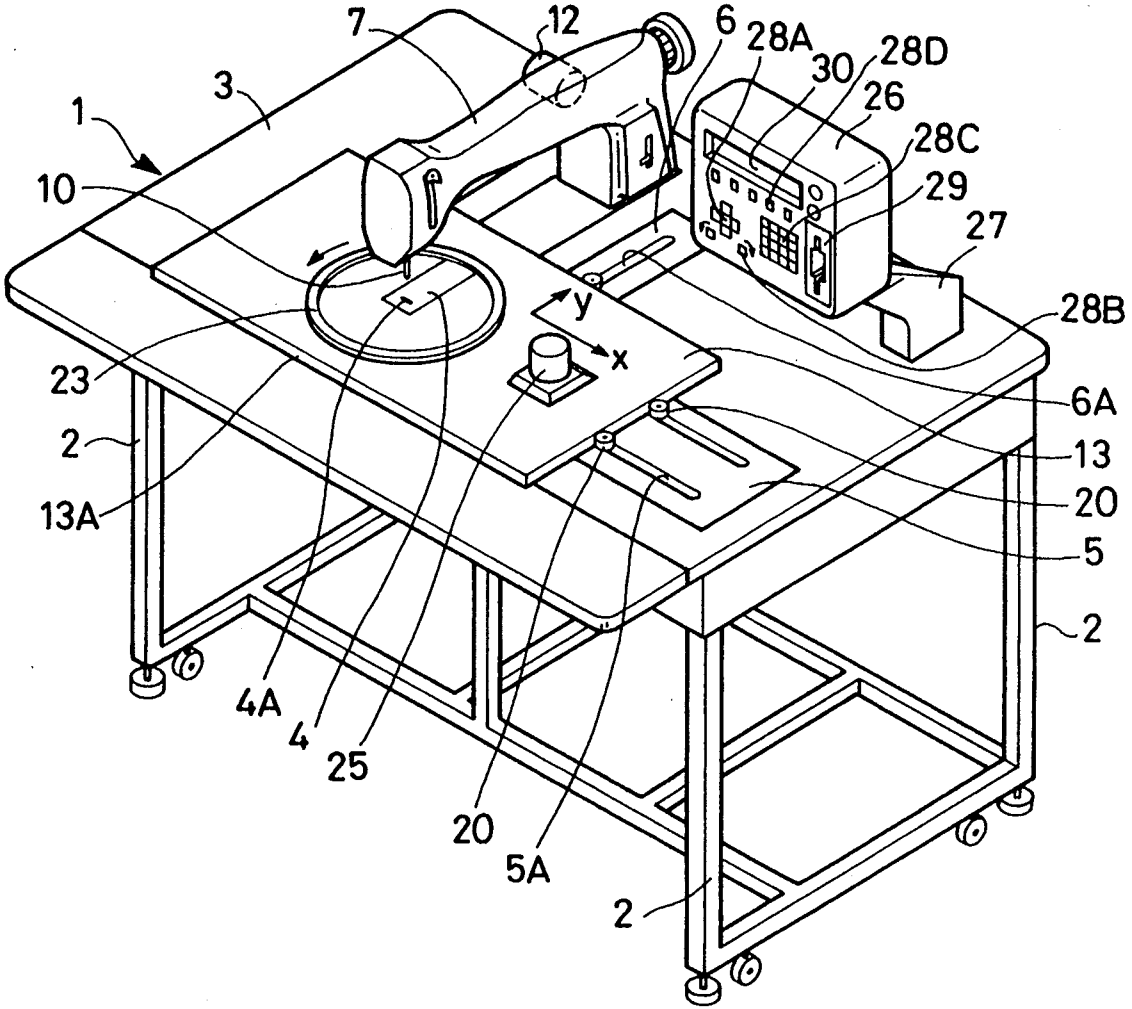
FIG. 1 is a perspective view of a turning zigzag sewing machine embodying the present invention.

Hereafter, the turning zigzag sewing machine of the present invention is explain more particularly, firstly by way of a turning zigzag embroidery machine shown as its preferred embodiment in FIGS. 1 through 10.

In these figures, indicated at 1 is a base table of a turning zigzag sewing machine, the base table 1 having a plural number of legs 2 and a support plate 3 which is mounted on the upper ends of the respective legs 2. The support plate 3 is provided with a needle plate 4 of a substantially oblong shape in a center portion beneath a movable frame 13 which will be described hereinlater. The needle plate 4 is bored with an elliptic needle hole 4A to receive an embroidering needle 10 which will be described later, and provided with a lower thread bobbin (not shown) on its lower side. Provided on top of the support plate 3 are a guide plate 5, which guides the movable frame 13 in sideward directions in the drawing (hereinafter referred to as "the direction of x-axis"), and a pair of guide plates 6 which guides the movable frame 13 in backward or forward directions (hereinafter referred to as "the direction of y-axis"). The guide plates 5 and 6 are provided with guide slots 5A and 6A (FIG. 4), respectively, to receive slidably the support shafts 20A of guide rollers 20 which will be described later.

Figure 2:
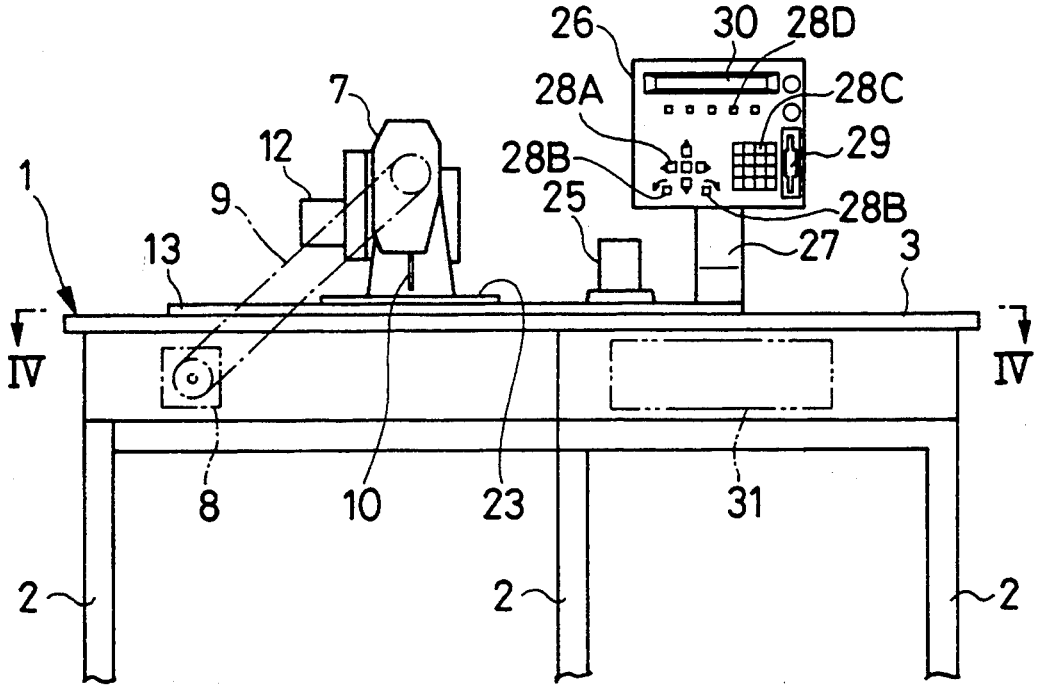
FIG. 2 is a front view of part of the zigzag sewing machine shown in FIG. 1.
Figure 3:
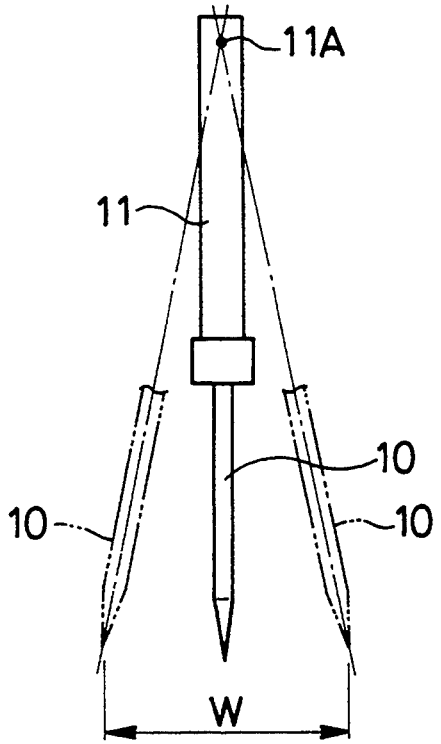
FIG. 3 is a diagrammatic illustration adopted to explain the rocking width of the embroidering needle relative to the needle axis.

Indicated at 7 is a head assembly of the embroidery machine, the machine head 7 being mounted on the support plate 3 and extended over the movable frame 13 in an overhanging fashion. The embroidery machine head 7 is linked through a belt 9 to a main spindle motor 8 which is mounted on the lower side of the support plate 3 as shown in FIG. 2 to drive the machine head 7, reciprocating the embroidering needle 10 with an upper thread up and down through a needle shaft 11 at a position which confronts the lower thread. The machine head 7 is further provided with a needle rocking motor 12 in the form of a pulse motor or the like, which is arranged to rock the embroidering needle 10 about a fulcrum point 11A on the needle shaft 11 to embroidering the needle 10 in sideward directions (in the direction of x-axis) across a given width W.

Denoted at 13 is the movable frame which is movably mounted on the support plate 3 at a predetermined position under the machine head 7. The movable frame 13 is substantially in the form of a plate of an oblong shape and provided with downwardly protruding rim portions 13A on its lower side. The movable frame 13 which has rim portions 13A gripped between guide rollers 20 is moved in the directions of x- and y-axes respectively by x- and y-axis motor which will be described later.

Indicated at 14 and 15 are x- and y-axis motors which are, for example, pulse motors serving as a drive source for the movable frame 13. These x- and y-axis motors 14 and 15 are located on the lower side of the support plate 3 along with pulleys 16 and 17 and timing belts 18 and 19. Output shaft 14A of the x-axis motor 14 drives the timing belt 18 in the direction of x-axis through the pulleys 16 and 17, while output shaft 15A of the y-axis motor 15 drives the respective timing belts 19 in the direction of y-axis through the pulleys 16 and 17.

Designated at 20 are the guide rollers which are mounted in halfway positions on the timing belt 18 and the timing belts 19 through movable plates 21 and 22, respectively. Each of these guide rollers 20 are rotatably mounted on the movable plate 21 or 22 through a support shaft 20A which is slidably received in the guide slot 5A or 6A in the guide plate 5 or 6 between the guide roller 20 and the movable plate 21 or 22.

In this instance, the guide rollers 20 which grip the rim portions 13A of the movable frame 13 are rotatable to shift the position of the frame 13 in the directions of x-and y-axes. Namely, when the timing belt 18 is driven by the x-axis motor 14, the movable frame 13 is displaced in the direction of x-axis through the movable plate 21. The displacement of the movable frame 13 in the x-axis direction is guided by the guide rollers 20 on the part of the movable plates 22. On the other hand, when the timing belts 19 are driven in the y-axis direction by the y-axis motor 15, the movable frame 13 is displaced in the direction of y-axis by the guide rollers 20 on the movable plates 22, and this displacement of the movable frame 13 in the y-axis direction is guided by the guide rollers 20 on the part of the movable plate 21.

Figure 7:
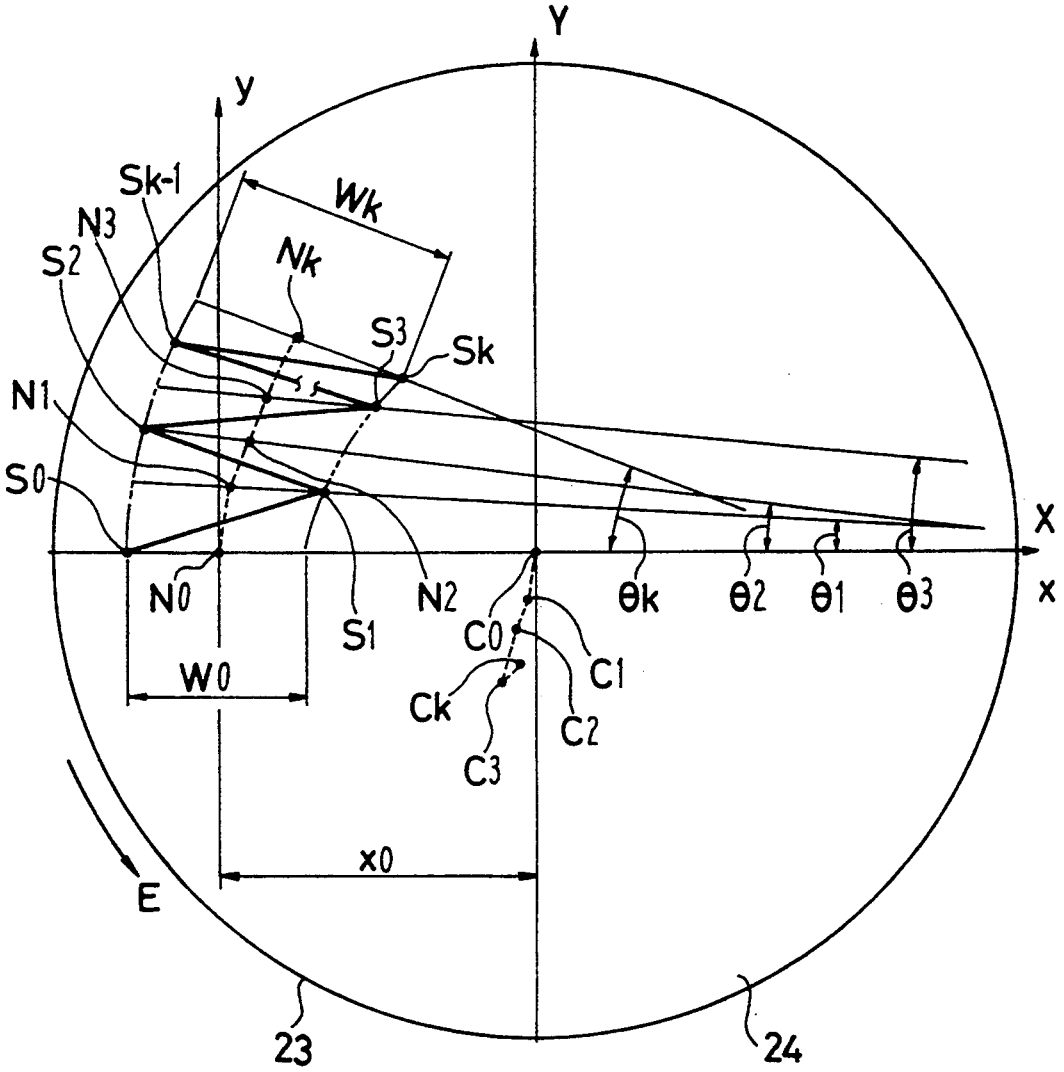
FIG. 7 is a diagrammatic illustration adopted to explain the stitch points of an embroidering needle on the cloth in relation with the needle center and the center of the rotatable frame.

Indicated at 23 is a rotatable frame which is rotatably mounted in a center portion of the movable frame 13, the rotatable frame 23 being arranged to hold embroidering cloth 24 in a stretched state as shown in FIG. 7 and being rotatable to turn the embroidering cloth 24 through a given angle $\theta$ about the center of the rotatable frame 23 on the movable frame 13. Denoted at 25 is a frame turning motor which is provided on the movable frame 13 as a drive source for the rotatable frame 23. The frame turning motor 25 has its output shaft linked to the rotatable frame 23 through a timing belt (not shown) to turn the rotatable frame 23 through a given angle $\theta$ on the movable frame 13. Similarly to the x- and y-axis motors 14 and 15, the frame turning motor 25 is constituted by a pulse motor, which can be operated by open-loop control to turn the rotatable frame 23 according to the number of signal pulses produced as a control signal by a machine control 31.

Indicated at 26 is an operating box which is mounted on the support plate 3 through a bracket 27. The operating box 26 is equipped with a keyboard 28 having frame moving keys 28A, frame turning keys 28B, ten keys 28C, software keys 28D etc, along with a floppy disk drive 29 and a display 30. In this instance, the software keys 28D have the functions of the so-called dialogue keys to be used according to a menu indicated on the display 30 at the time of data read-in or read-out, data input or output, or scale-up or scale-down operations, and also at the time of setup of machine conditions, pattern alterations, pattern selections, addition of patterns, Joining patterns, color alterations etc.

The frame moving keys 28A of the keyboard 28 are manipulated by an operator to actuate the x-axis motor 14 or the y-axis motor 15 which drives the movable frame 13 in the direction of x-axis or y-axis over a distance commensurate with a time duration of the key manipulation. The frame turning keys 28B are manually operated, for example, at the time of bringing the embroidering cloth 24 on the rotatable frame 23 to a predetermined angular position prior to reproduction of an embroidery pattern. Namely, the embroidering cloth 24 can be turned together with the rotatable frame 23 by the frame turning motor 25 in response to a manual key operation.

Figure 4:
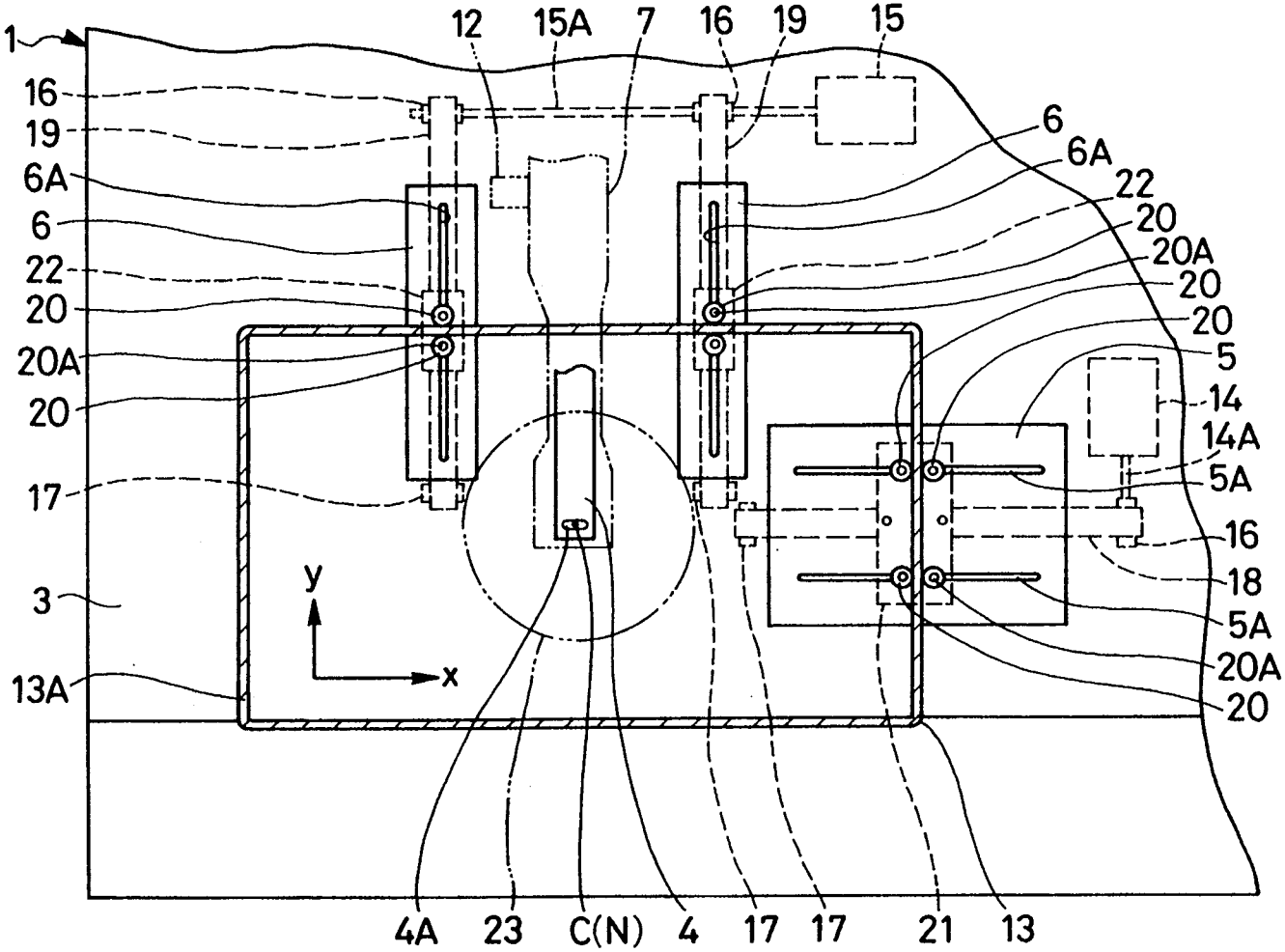
FIG. 4 is an enlarged sectional view taken on line IV—IV of FIG. 2, showing mechanisms for shifting the position of the movable frame.

On the other hand, zero-point detection switches (not shown) for the x- and y-axes are mounted on the support plate 3, for example, in positions under the movable plates 21 and 22. As shown in FIG. 4, when the center C of the rotatable frame 23 comes to a point which registers on the center N of the embroidering needle 10, this is detected by the zero-point detection switches through the movable plates 21 and 22 to let the machine control 31 recognize that the movable frame 13 is located at the original point relative to the embroidering needle 10. The original points of the rotational angle $\theta$ and the zigzag width W are detected in a similar manner although descriptions in this regard are omitted for the sake of simplicity of explanation.

Figure 5:
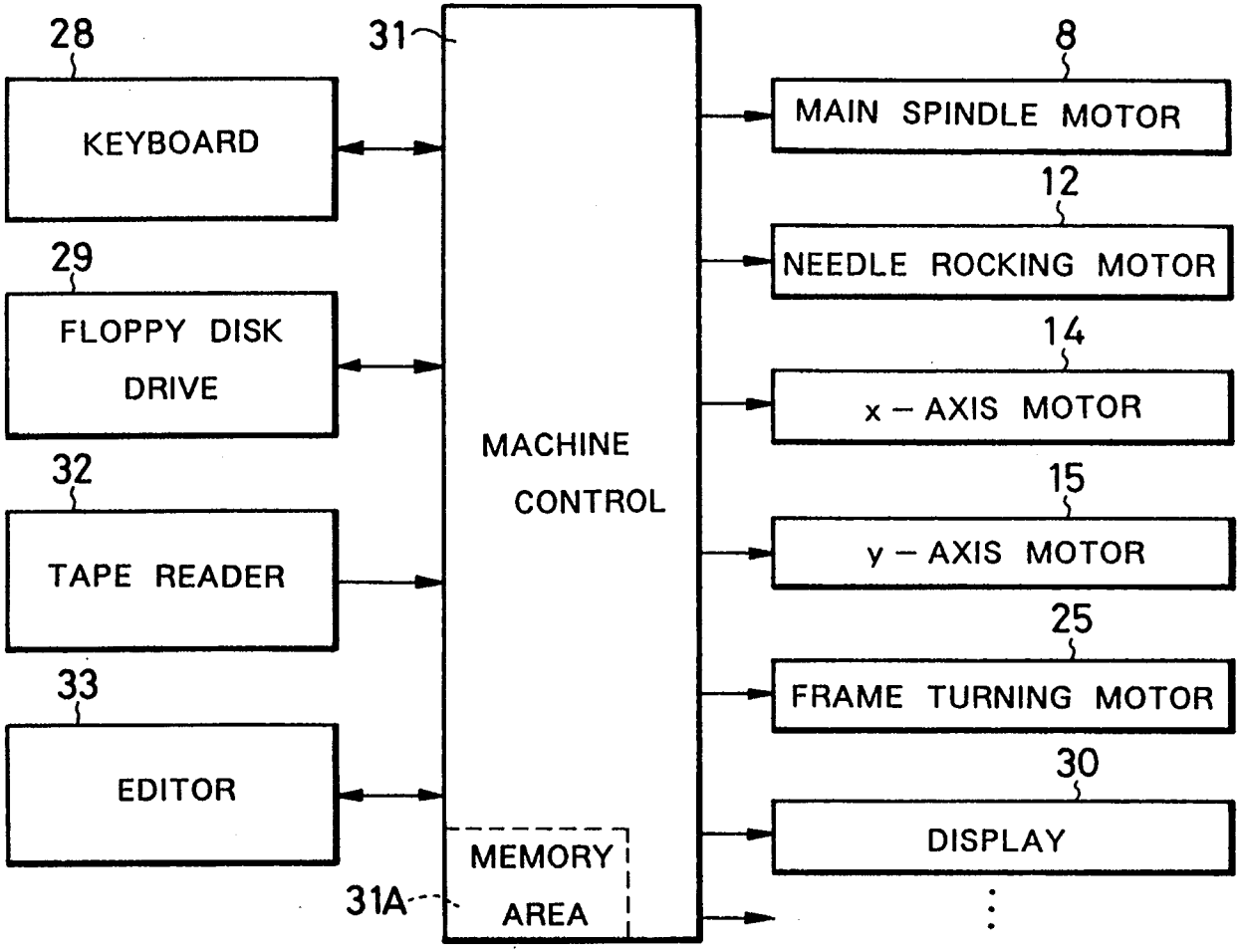
FIG. 5 is a block diagram of a control system for the turning zigzag sewing machine shown in FIG. 1.

Indicated at 31 is the afore-mentioned machine control which is mounted on the lower side of the support plate 3 at a position in the vicinity of the operating box 26. The machine control 31 is constituted by a microcomputer or the like, which is provided with a number of input ports to connect thereto the keyboard 28 and floppy disk drive 29 as shown in FIG. 5 and which is in some cases additionally connectible to a tape reader 32 and an editor 33 or to a pattern maker or input device and a teaching machine (both not shown), for example, through a communication line. Further, the machine control 31 has its output ports connected to the aforementioned main spindle motor 8, needle spindle rocking motor 12, x-axis motor 14, y-axis motor 15, frame turning motor 25 and display 30.

Figure 6:
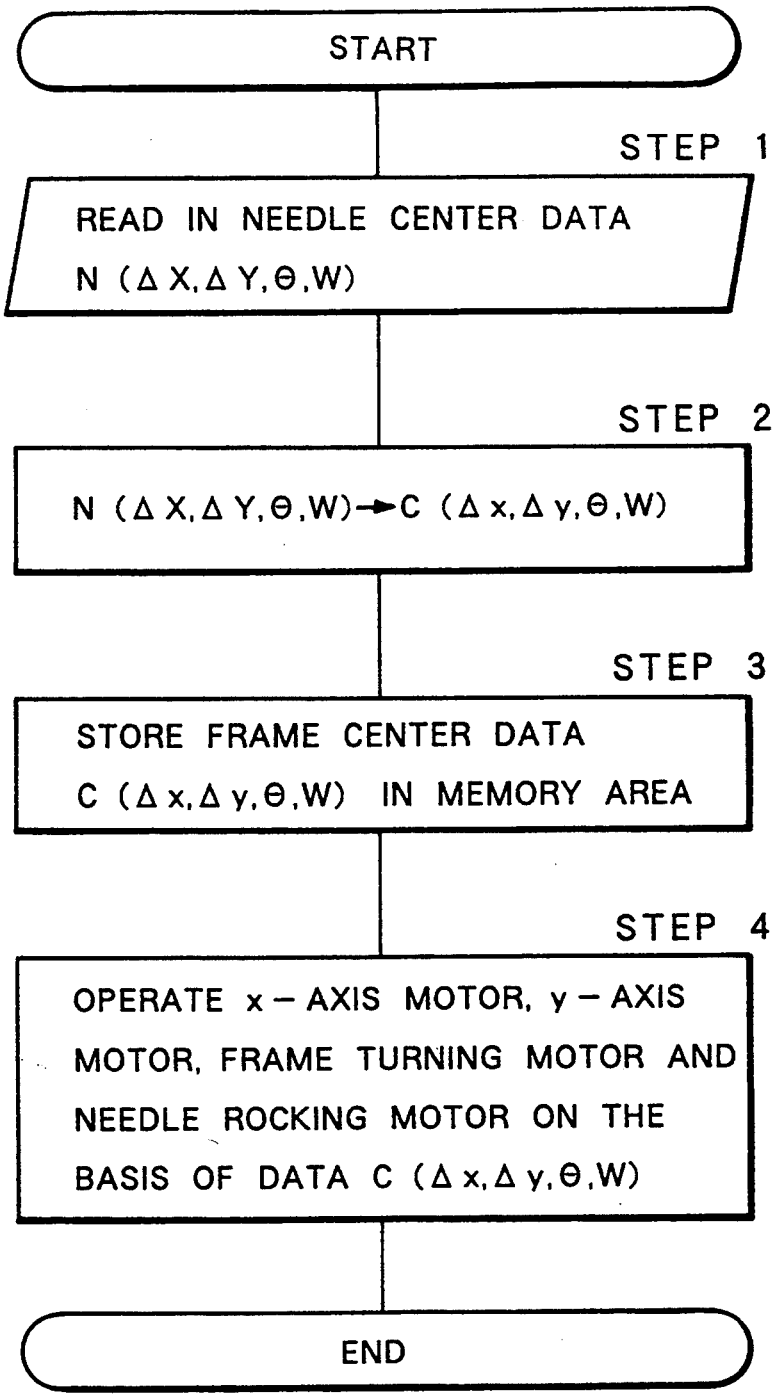
FIG. 6 is a flow chart of a process of arithmetic data conversion and machine control.

The machine control 31 stores in its memory circuit a control program as shown in FIG. 6 to execute an arithmetic data conversion process and a machine control process. Further, the memory circuit of the machine control 31 is provided with a memory area 31A to store therein frame center data C ($\Delta x$, $\Delta y$, $\theta$, W) of the rotatable frame center C, which are obtained after the arithmetic data conversion as will be described hereinlater.

Figure 8:
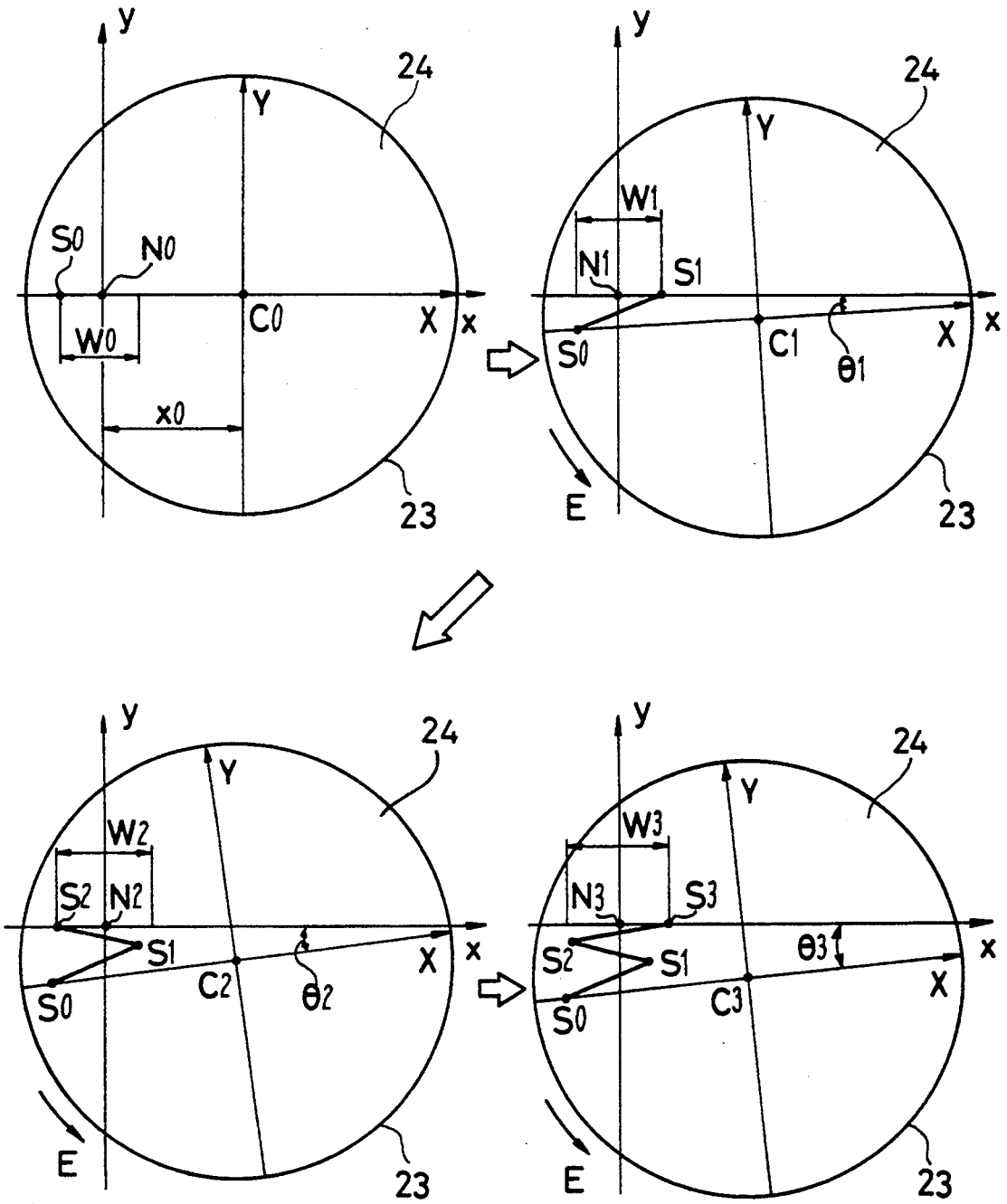
FIG. 8 is a diagrammatic illustration adopted to explain the successive movements of the rotatable frame and the frame center relative to needle center during an operation of reproducing an embroidery pattern on the cloth.

The data N ($\Delta X$, $\Delta Y$, $\theta$, W) of the embroidering needle center N, which have been read in from outside, are converted into data C ($\Delta x$, $\Delta y$, $\theta$, W) of the frame center C according to Formula 10 which will be described later, and the operations of the x-axis motor 14, y-axis motor 15, frame turning motor 25 and needle rocking motor 12 are controlled on the basis of the frame center data C ($\Delta x$, $\Delta y$, $\theta$, W). Consequently, the movable frame 13 and rotatable frame 23 are moved or turned as exemplified in FIGS. 8 and 9 to advance the embroidering needle 10 successively to stitch points S0, S1, S2, S3 and so forth. FIG. 8 particularly shows how the embroidering needle 10 is routed successively through the stitch points S0, S1, S2 and S3 in that order as the rotatable frame 23 is successively moved to shifted positions as indicated by blank arrows.

More particularly, in order to shift the center C of the rotatable frame 23 to position C0 from a start point or initial position N0, for example, firstly the position of the movable frame 13 is shifted by a distance x0 parallelly in the direction of x-axis together with the rotatable frame 23. In this state, the embroidering needle 10 is located at the initial position N0. Upon rocking the embroidering needle 10 with a rocking width W0, a swinging motion of the embroidering needle 10 is started to advance same to the stitch point S0 which is at a rocking width of W0/2 from the start point N0. Since at this time the rotational angle $\theta$ is zero, the position of the frame center C0 is stored in the memory area 31A of the machine control 31 as $$C0\ (x0,\ y0,\ \theta 0,\ W0) \qquad \text{[Formula 1]}$$

where $y0=0$, $\theta 0=0$

Nextly, in order to bring the embroidering needle 10 to the needle center N1, the position of the movable frame 13 is shifted together with the rotatable frame 23 which is at the same time turned in the direction of the arrow E through a rotational angle of $\theta=\theta 1$ to relocate the frame center C at C1 of FIG. 8. This time the needle rocking width W is set at W1 to swing the needle to the next stitch point S1 which is at a rocking width of W12 from the needle center N1. At this position, the coordinates of the frame center C1 on the x–y axes are (x1 and y1) relative to the needle center N1, and the rotational angle $\theta$ is $\theta 1$. Accordingly, the position of the frame center C1 is stored in the memory area 31A as $$C1\ (\Delta x1,\ \Delta y1,\ \theta 1,\ W1) \qquad \text{[Formula 2]}$$

where $\Delta x1=x1-x0$ $\Delta y1=y1-y0$

Thereafter, in the same manner, the position of the movable frame 13 is successively shifted together with the rotatable frame 23 to bring the embroidering needle 10 successively to the needle centers N2 and N3 as indicated by arrows in FIG. 8, accompanied by rotations of the rotatable frame 23 through $\theta=\theta 2$ and $\theta=\theta 3$ in the direction of the arrow E to relocate the frame center C at C2 and C3. In case the values of the rocking width W at these shifted positions are set at W2 and W3, the positions of the frame centers C2 and C3 relative to the needle centers N2 and N3 are respectively stored in the memory area 31A as $$C2\ (\Delta x2,\ \Delta y2,\ \theta 2,\ W2) \qquad \text{[Formula 3]}$$

where $\Delta x2=x2-x1$ $\Delta y2=y2-y1$ $$C3\ (\Delta x3,\ \Delta y3,\ \theta 3,\ W3)$$

where $\Delta x3=x3-x2$ $\Delta y3=y3-y2$

Figure 9:
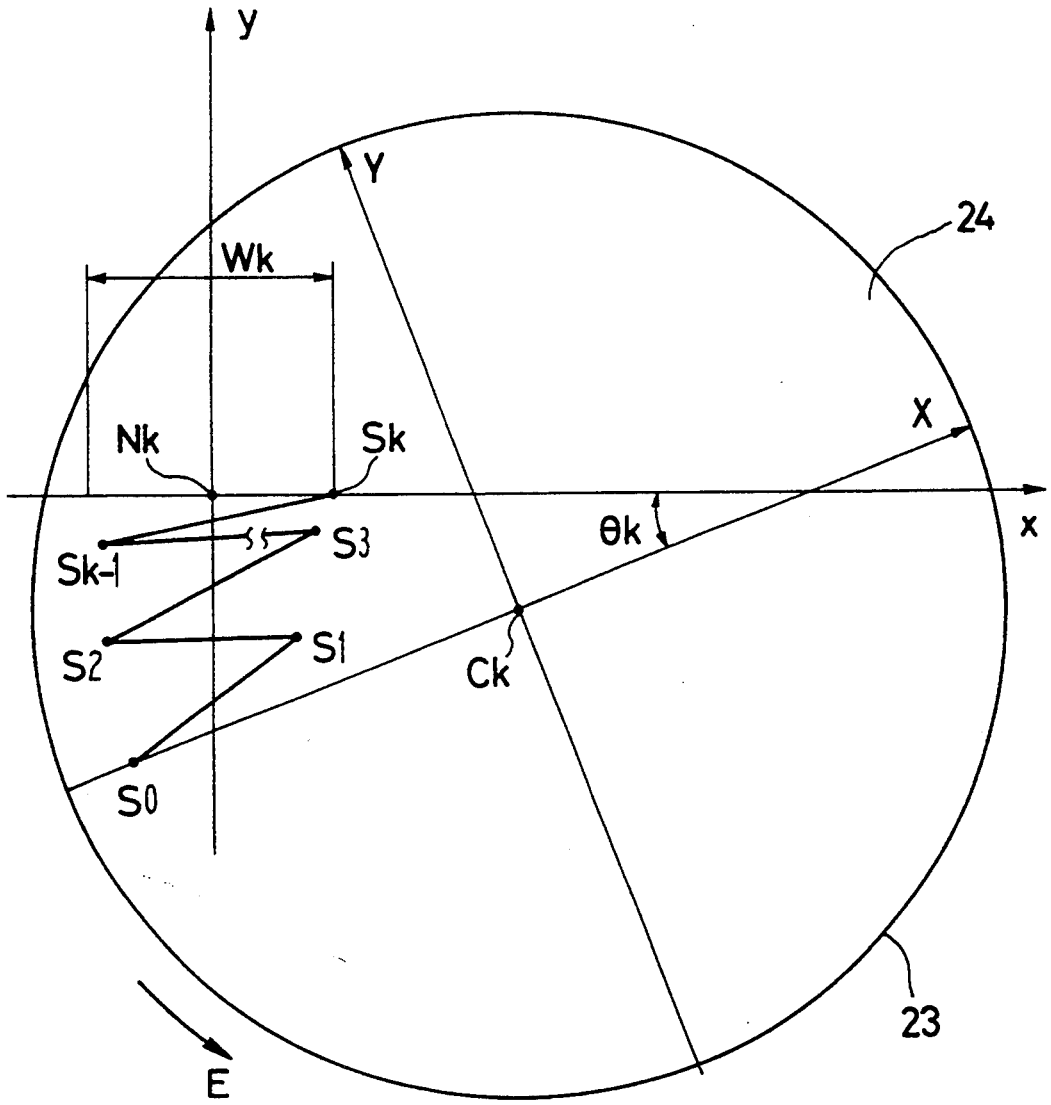
FIG. 9 is a diagrammatic illustration adopted to explain the relations between the frame center and the needle center after forming a certain embroidery pattern.

Then, as shown in FIG. 9, in order to relocate the embroidering needle 10 at the needle center Nk, the rotatable frame 23 is likewise shifted in the directions of the x- and y-axes accompanied by a rotation through an angle of $\theta=\theta k$ in the direction of the arrow E to relocate the frame center C at Ck. If the rocking width W is set at Wk, the position of the frame center Ck relative to the needle center Nk is stored in the memory area 31A as $$Ck\ (\Delta xk,\ \Delta yk,\ \theta k,\ Wk) \qquad \text{[Formula 4]}$$

where $\Delta xk=xk-xk-1$ $\Delta yk=yk-yk-1$

Namely, the embroidering needle 10 is located at the start position N0 at the initial point of the embroidery pattern input or forming operation where the rocking width W is zero, and thereafter it is relocated successively to N1, N2, N3 . . . Nk, while the rotatable frame 23 is successively turned in the direction of the arrow E through $\theta=\theta 1$, $\theta 2$, $\theta 3$, . . . $\theta k$ on the movable frame 13 which is shifted in the directions of x- and y-axes.

As a consequence, while the embroidering needle 10 is advanced successively from the stitch point S1 to the stitch points S1, S2, S3, . . . Sk, the center of the rotatable frame 23 is successively shifted from C0 to C1, C2, C3, . . . Ck as indicated by a broken line in FIG. 7. At each of these positions, the data of the frame center C0, C1, C2, C3, . . . Ck, taken on the basis of the needle center N, namely, taken on the basis of the start point N0 of FIG. 7, are stored in the memory area 31A according to the above-described Formulas 1 to 4 to provide frame center data C ($\Delta x$, $\Delta y$, $\theta$, W) corresponding to the needle center N.

On the other hand, the machine control 31 reads in, for example, from a floppy disk on the floppy disk drive 29 (or from a suitable memory medium), scalable or editable stitch data which have been prepared by means of a stitch data input device as mentioned hereinbefore in connection with the prior art, namely, the data of the needle center N (including the start point N0 in addition to N1, N2, N3, . . . Nk) relative to the frame center C (C0, C1, C2, C3, . . . Ck) on the X–Y axes as exemplified in FIGS. 7 to 9, to obtain data of the needle center N corresponding to the frame center C.

In this instance, when the needle center N is shifted from Nn (Xn, Yn) to Nn+1 (Xn+1, Yn+1), where $n=0, 1, 2, 3, \ldots k-1$, on the X–Y coordinate system of FIG. 7, the data N ($\Delta X$, $\Delta Y$, $\theta$, W) of the needle center N expresses the quantity of displacement ($\Delta X$, $\Delta Y$) as $$\Delta X=(Xn+1)-(Xn) \qquad \text{[Formula 5]}$$

$$\Delta Y=(Yn+1)-(Yn)$$

With regard to the angle of the stitch point S (including stitch points S0, S1, S2, S3, . . . Sk) with the needle center N (including the start point N0 and the needle center positions N1, N2, N3, . . . Nk) is expressed as a rotational angle $\theta$ (including the rotational angles $\theta 0$, $\theta 1$, $\theta 2$, $\theta 3$, . . . $\theta k$).

In this manner, the turning zigzag machine can reproduce an embroidery pattern on the cloth 24 by shifting the rotatable frame 23 along with the movable frame 13. Namely, an embroidery pattern cannot be reproduced on the cloth 24 through the control of operations of the x- and y-axis motors 14 and 15 or similar drive means unless the needle center data N (ΔX, ΔY, θ, W), taken on the basis of the frame center C, are converted into frame center data C taken on the basis of the needle center N on the x–y axes, namely, into data C (Δx, Δy, θ, W) of the frame center C relative to the needle center N.

To this end, the machine control 31 is arranged to arithmetically convert the data N (ΔX, ΔY, θ, W) of the needle center N into data C (Δx, Δy, θ, W) of the frame center C according to Formula 10, which will be given hereinlater, controlling operations of the x-axis motor 14, y-axis motor 15, frame turning motor 25 and needle rocking motor 12 by open-loop control based on the converted frame center data C (Δx, Δy, θ, W).

Figure 10:
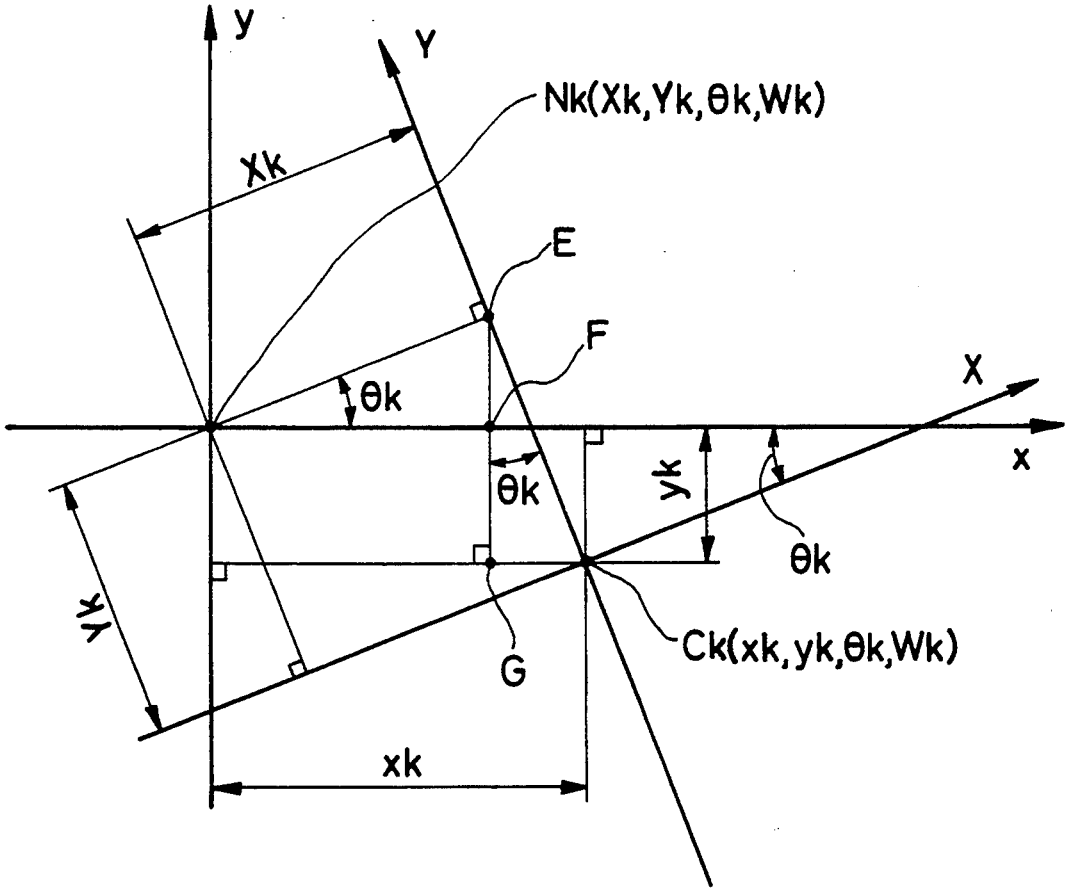
FIG. 10 is a diagrammatic illustration adopted to explain the relations between the frame center and the needle center.

More specifically, of the data N (ΔX, ΔY, θ, W) of the needle center N relative to the frame center C on the X–Y coordinate system, which have been read in from a floppy disk on the floppy disk drive 29, for example, the needle center data Nk of FIG. 9 are expressed as Nk (Xk, Yk, θk, Wk) as shown in FIG. 10. In this instance, since the right-angled triangle which is formed by the points Nk, E and F is similar to the right-angled triangle which is formed by the points E, G and Ck, the x–y coordinate data (xk, yk) of the frame center Ck relative to the needle center Nk (at the original point of the x–y coordinate system) can be expressed by means of trigonometric functions based on the rotational angle θk, as $$\begin{aligned} xk &= Xk\cos\theta k + Yk\sin\theta k \\ yk &= Yk\cos\theta k - Xk\sin\theta k \\ &= -(Xk\sin\theta k - Yk\cos\theta k) \end{aligned} \quad \text{[Formula 6]}$$

Then, according to Formula 6, the data of the needle center Nk on the X–Y axes are converted into data of the frame center Ck on the x–y axes through an arithmetic conversion as expressed by $$Nk\ (Xk, Yk, \theta k, Wk) \rightarrow Ck\ (xk, yk, \theta k, Wk) \quad \text{[Formula 7]}$$

Similarly, the data of the needle center Nk−1 on the X–Y axes can be converted into the data of the frame center Ck−1 on the x–y axes by an arithmetic conversion as expressed by $$Nk-1\ (Xk-1, Yk-1, \theta k-1, Wk-1) \rightarrow Ck-1\ (xk-1, yk-1, \theta k-1, Wk-1) \quad \text{[Formula 8]}$$

Accordingly, the frame center Ck can be obtained by arithmetic conversion of the data of the needle center Nk, as expressed by $$Nk\ (\Delta Xk, \Delta Yk, \theta k, Wk) \rightarrow Ck\ (\Delta xk, \Delta yk, \theta k, Wk) \quad \text{[Formula 9]}$$

where $\Delta xk = xk - xk-1$ $\Delta yk = yk - yk-1$

In a similar manner, the data conversion is carried out with respect to the needle center N1, N2, N3, and so forth (where k=1, 2, 3, . . . ).

Thus, according to Formulas 6 to 9, the machine control 31 carries out an arithmetic conversion to convert the data N (ΔX, ΔY, θ, W) of the needle center N relative to the frame center C into data C (Δx, Δy, θ, W) of the frame center C, as expressed by $$N\ (\Delta X, \Delta Y, \theta, W) \rightarrow C\ (\Delta x, \Delta y, \theta, W) \quad \text{[Formula 10]}$$

Of the data C (Δx, Δy, θ, W) of the frame center C, the quantity of displacement (Δx, Δy) of the frame center C can be obtained, for example, when the frame center Cn (xn, yn) is shifted to Cn+1 (xn+1, yn+1) (where n=0, 1, 2, . . . k−1), as expressed by $$\Delta x = (xn+1) - (xn) \quad \text{[Formula 11]}$$

$$\Delta y = (yn+1) - (yn)$$

The turning zigzag sewing machine according to the present invention, with the above-described constitution, carries out an arithmetic data conversion process and a machine control process by means of the machine control 31 in the manner as will be described hereinlater with reference to FIG. 6.

Firstly, upon starting a processing operation, for example, the machine control 31 reads in needle center data N (ΔX, ΔY, θ, W) from a floppy disk on the floppy disk drive 29, and stores all of the read-in needle center data in the memory area 31A. Nextly, it goes to Step 2 to convert the data N (ΔX, ΔY, θ, W) of the needle center N to data C (Δx, Δy, θ, W) of the frame center C by the arithmetic conversion according to afore-mentioned Formula 10. In Step 3, the arithmetically converted data C (Δx, Δy, θ, W) of the frame center C are stored in the memory area 31A with respect to each of the frame centers C0, C1, C2, C3, . . . Ck according to Formulas 1 to 4.

In Step 4, on the basis of the data C (Δx, Δy, θ, W) of the frame center C stored in Step 3, the machine control 31 produces control pulse signals for the x-axis motor 14, y-axis motor 15, frame turning motor 25 and needle rocking motor 12 to operate these drive members by open-loop control.

As a result, in order to locate the embroidering needle 10 at the initial position N0 on the embroidering cloth 24 of FIGS. 7 and 8, the position of the rotatable frame 23 is shifted in the directions of x- and y-axes together with the movable frame 13 with a rotational angle of θ0=0 thereby bringing the frame center C to C0. At this time, the embroidering needle 10 on the machine head 7 is advanced to the initial position N0. Then, the embroidering needle 10 is rocked by the needle rocking motor 12 about the fulcrum point 11A of the needle shaft 11 (FIG. 3), for example, rocked to the left in FIG. 7 over a width of W0/2 to let the embroidering needle 10 make a stitch at the stitch point S0.

Thereafter, in order to advance the embroidering needle 10 to the needle center N1, the rotatable frame 23 is turned through a rotational angle θ1 by the frame turning motor 25 in the direction of the arrow E in FIG. 8, and the movable frame 13 is shifted in the directions of x- and y- axis by the x- and y-axis motors 14 and 15 to locate the frame center C at C1. In this state, the embroidering needle 10 on the machine head 7 is rocked to the right in FIG. 8 across a given rocking width W1, followed by rotation of the main spindle motor 8 causing the embroidering needle 10 to make a stitch at the stitch point S1.

Thereafter, in order to relocate the frame center C successively to C2, C3, . . . in the order indicated by blank arrows in FIG. 8, the position of the rotatable frame 23 is successively shifted in the directions of x-and y-axes together with the movable frame 13 by operations of the x-axis motor 14 and the y-axis motor 15, accompanied by a rotation through an angle of $\theta 2$, $\theta 3$, . . . in the direction of the arrow E by operations of the frame turning motor 25. At this time, the embroidering needle 10 on the machine head 7 is rocked at each of the needle center positions N2, N3, . . . by the needle rocking motor 12 across a predetermined rocking width W2, W3, . . . to form a stitch at each of the stitch points S2, S3, . . . by rotation of the main spindle motor 8.

Further, regarding the stitch point Sk shown in FIG. 9, the embroidering needle 10 is located at the needle center Nk by turning the rotatable frame 23 through a rotational angle of $\theta = \theta k$ in the direction of the arrow E while its position is shifted in the directions of x- and y-axes to position the frame center C at Ck. The embroidering needle 10 at the needle center Nk is rocked by the machine head 7 across a rocking width Wk to form a stitch at the stitch point Sk, thereby reproducing a predetermined embroidery pattern on the cloth 24.

Thus, according to the present embodiment, the read-in data N ($\Delta X$, $\Delta Y$, $\theta$, W) of the needle center N, which permit scaling up or down or alteration of an embroidery pattern, are arithmetically converted into the frame center data C ($\Delta x$, $\Delta y$, $\theta$, W) thereby to control the operations of the x-axis motor 14, y-axis motor 15, frame turning motor 25 and needle rocking motor 12. It follows that the present embodiment makes it possible to reproduce an embroidery pattern of improved quality on the basis of externally read-in pattern data.

Besides, the x-axis motor 14, y-axis motor 15, frame turning motor 25 and needle rocking motor 12, which are constituted by pulse motors, can be driven by an open-loop control according to output pulse signals from the machine control 31. Therefore, by elimination of the position sensor means for detection of the amounts of displacement in the x- and y-axes directions, rotational angle sensor means for detection of the rotational angle or rocking width sensor means for detection of the needle rocking width, this embodiment of the present invention contributes to reduce the number of component parts to a marked degree, as compared with the conventional turning zigzag sewing machine which is adapted to read a teaching operation as mentioned hereinbefore in connection with the prior art, and to enhance the working factors in the assembling stage.

In the foregoing embodiment, Steps 1 and 2 of the program of FIG. 6 respectively show particulars of the operations by the data read-in means and the arithmetic conversion means which are essential to the present invention, while Step 4 particulars of the operation by the embroidery machine operation control means.

Further, in the foregoing embodiment, it has been described that the data C ($\Delta x$, $\Delta y$, $\theta$, W), as obtained after the arithmetic conversion in Step 3 of FIG. 6, are stored in the memory area 31A of the machine control 31. However, the present invention is not restricted to this particular arrangement, and the machine control 31 may be arranged to store the arithmetically converted data C ($\Delta x$, $\Delta y$, $\theta$, W), for example, on the floppy disk drive 29 or other external memory means which is accessible from time to time during operations of the turning zigzag sewing machine to fetch the stored frame center data C.

Moreover, prior to the arithmetic conversion in Step 2, the needle center data N ($\Delta X$, $\Delta Y$, $\theta$, W), which are read in at Step 1 of FIG. 6, may be edited by way of the software keys 28D of the keyboard 28 on the machine control 31, for example, to scale up or down an embroidery pattern. Namely, the read-in data may be edited before the arithmetic conversion in Step 2 if desired.

Furthermore, in the above-described embodiment, the needle center data N which permit scaling up or down of an embroidering pattern are described as being prepared on the basis of a teaching operation by the use of a stitch input device, followed by arithmetic conversion of the resulting needle center data N to the corresponding frame center data C. However, in this regard, the present invention is not restricted to this particular form of pattern data preparation. For example, it is also possible to prepare needle center data N ($\Delta X$, $\Delta Y$, $\theta$, W), including the rotational angle $\theta$ and the rocking width W, from stitch data which have been entered by the use of a tablet or other pattern input device. In the same manner as described hereinabove, these data of the needle center N are read in by the machine control and converted into the frame center data C ($\Delta x$, $\Delta y$, $\theta$, W) thereby to control the operations of the turning zigzag embroidery machine.

In such a case, when converting the needle center data N which were prepared by the use of a tablet or other pattern input device, into the frame center data C by the machine control 31, it suffices to input an arbitrary offset value for the displacement x0 through ten keys 28C on the keyboard 28. By so doing, as exemplified in FIG. 8, when starting the embroidering operation, the start point N0 of the needle center N is located at the original point of the x–y coordinates, thereby automatically locating the frame center C of the rotatable frame 23 at C0 which is shifted parallelly in the direction of x-axis by the arbitrary amount of displacement x0 from the start point N0. Thereafter, the frame center C is successively shifted to the frame center positions C1, C2, C3, . . . Ck to reproduce an embroidery pattern substantially in the same manner as in the above-described embodiment.

In the foregoing embodiments, the x-axis of the x–y coordinates is located in concordance with the X-axis of the X–Y coordinates in the initial phase of an embroidering operation as shown in FIGS. 7 and 8. However, the x-axis is not necessarily required to be initially located on the same line as the X-axis, and the two axes may be started from intersecting positions with a certain angle (a rotational angle $\theta$) with each other.

Figure 11:
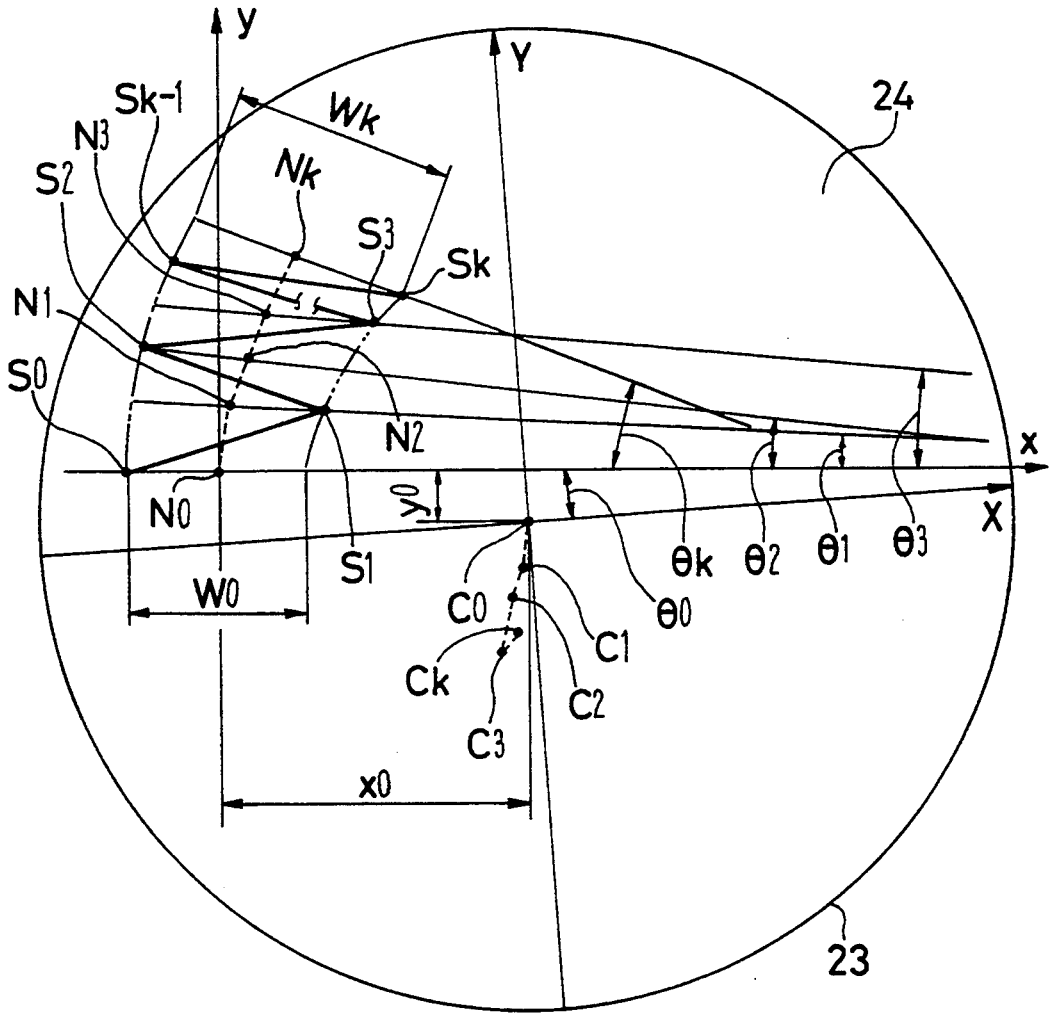
FIG. 11 is a diagrammatic illustration explanatory of similar relations in a modified embodiment of the invention.

Namely, for example, as seen in the modification of FIG. 11, the frame shift keys 28A and frame turn keys 28B may be manipulated before starting an embroidering operation to locate the frame center C0 at the original point of X–Y coordinates, which is shifted from the start point N0 at the original point of x–y coordinates in the directions of x- and y-axes by an arbitrary offset value (e.g., a shift of x0, y0), so that the two axes are initially intersected with each other with a certain angle (rotational angle $\theta$). Even in case an embroidering operation is started in this state, the frame center C of the rotatable frame 23 is successively shifted to the positions of C1, C2, C3, . . . Ck according to Formulas 2 to 4 to reproduce an embroidery pattern in the same manner as in the foregoing embodiments.

POSSIBILITIES OF INDUSTRIAL UTILIZATION

It will be clear from the foregoing detailed description that, according to the present invention, the turning zigzag embroidery machine is arranged to read in needle center data which permits scaling up or down of an embroidery pattern, and after arithmetically converting the read-in needle center data into frame center data, to control the operations of the machine head and the movable and rotatable frame drive sources on the basis of the converted frame center data, making it possible to edit an embroidery pattern for scaling up or down its size or to add alterations thereto whenever necessary and, after editing, to reproduce a corresponding embroidery pattern of improved quality in a more reliable manner as compared with the conventional turning zigzag sewing machines which depend upon prior teaching operations.

Besides, in case a pulse motor is employed for each of the drive sources including the x-axis motor, y-axis motor, rotatable frame drive motor and needle rocking motor, it becomes feasible to drive and control each pulse motor by open-loop control according to pulse signals which are produced by the embroidery machine operation control means on the basis of the arithmetically converted frame center data. Thus, the present invention makes it possible to obviate various components parts which have been necessary on the conventional turning zigzag sewing machines relying on teaching operations, for example, to obviate the position sensors means for detection of frame displacements in the directions of x- and y-axes, the rotational angle sensor means for detection of frame rotations, and the rocking width sensor means for detection of needle rocking width, succeeding in reducing the number of component parts to a marked degree and improving the working factors in the assembling stage in a reliable manner.

What is claimed is:

1. A turning zigzag embroidery machine of the type having a base table for positioning a lower embroidery thread thereon, an embroidery machine head located over the base table and arranged to reciprocate an embroidering needle with an upper thread up and down in a confronting position relative to a lower thread and at the same time to impart a rocking motion to said embroidering needle over a predetermined width W, a movable frame provided movably on said base table at a position under said embroidery machine head and driven from a movable frame drive source for movements in directions of x- and y-axes on said base table, and a rotatable frame adapted to hold embroidering cloth in a stretched state within said movable frame and rotated by a rotatable frame drive source on said movable frame to turn said embroidering cloth through a given rotational angle $\theta$ within said movable frame, wherein said turning zigzag embroidery machine comprises:

a data read-in means for reading in input needle center data including said needle rocking width W of said embroidering needle and said rotational angle $\theta$;

an arithmetic conversion means for converting said input needle center data including said rotational angle $\theta$ and said needle rocking width W into frame center data, wherein said arithmetic conversion means converts needle center data N ($\Delta X$, $\Delta Y$, $\theta$, W), read in through said data read-in means, into frame center data C ($\Delta x$, $\Delta y$, $\theta$, W) by means of trigonometric functions based on said rotational angle $\theta$; and an embroidery machine operation control means for controlling operations of said embroidery machine head and said movable and rotatable frame drive sources according to said arithmetically converted frame center data from said arithmetic conversion means.

2. A turning zigzag embroidery machine as defined in claim 1, wherein said movable frame drive source is constituted by an x-axis motor for driving said movable frame in the direction of the x-axis and a y-axis motor for driving said movable frame in the direction of the y-axis, said rotatable frame drive source is constituted by a frame rotating motor adapted to turn said rotatable frame through said rotational angle $\theta$ on said movable frame, and said embroidery machine head is provided with a needle rocking motor for imparting a rocking motion to said embroidering needle across said rocking width W.

3. A turning zigzag embroidery machine as defined in claim 2, wherein each of said x-axis motor, y-axis motor, frame turning motor and needle rocking motor is respectively constituted by a pulse motor to be operated by open-loop control according to pulse signals produced by said embroidery machine operation control means on the basis of said arithmetically converted frame center data.

* * * * *

UNITED STATES PATENT AND TRADEMARK OFFICE

CERTIFICATE OF CORRECTION

PATENT NO. : 5,438,942

DATED : August 8, 1995

INVENTOR(S) : Akira OKUNO, et al.

It is certified that error appears in the above-indentified patent and that said Letters Patent is hereby corrected as shown below:

Please omit the Foreign Application Priority Data from the title page.

On the title page, Items [21], [22], [86] and [87], the PCT information has been omitted. It should read:

| | |
|---|---|
| --[21] Appl. No.: | 133,143 |
| [22] PCT Filed: | Mar. 31, 1993 |
| [86] PCT No.: | PCT/JP93/00403 |
| § 371 Date: | Oct. 20, 1993 |
| § 102 (e) Date: | Oct. 20, 1993 |
| [87] PCT Pub. No.: | WO94/23108 |
| PCT Pub. Date: | Oct. 13, 1994 |

Signed and Sealed this

Twelfth Day of March, 1996

Bruce Lehman

*Attest:*

BRUCE LEHMAN

*Attesting Officer*

*Commissioner of Patents and Trademarks*